US009120212B2

(12) United States Patent
Yang

(10) Patent No.: US 9,120,212 B2
(45) **Date of Patent: *Sep. 1, 2015**

(54) RATCHET AND METHOD FOR MAKING THE SAME

(71) Applicant: Cheng-Pu Yang, Changhua (TW)

(72) Inventor: Cheng-Pu Yang, Changhua (TW)

( * ) Notice: Subject to any disclaimer, the term of this patent is extended or adjusted under 35 U.S.C. 154(b) by 220 days.

This patent is subject to a terminal disclaimer.

(21) Appl. No.: 13/759,076

(22) Filed: Feb. 5, 2013

(65) Prior Publication Data

US 2014/0216211 A1 Aug. 7, 2014

Related U.S. Application Data

(63) Continuation-in-part of application No. 13/301,765, filed on Nov. 21, 2011, now Pat. No. 8,646,363.

(51) Int. Cl.
*B25B 23/00* (2006.01)
*B25B 13/46* (2006.01)

(52) U.S. Cl.
CPC ..... *B25B 23/00* (2013.01); *B25B 13/463* (2013.01)

(58) Field of Classification Search
CPC ..... B25B 23/00; B25B 13/463; C25D 5/48; C25D 7/14
USPC ..... 81/60; 76/10; 427/256, 271; 205/221
See application file for complete search history.

(56) References Cited

U.S. PATENT DOCUMENTS

| | | | | |
|---|---|---|---|---|
| 8,418,587 | B2 * | 4/2013 | DeBaker | 81/436 |
| 8,646,363 | B2 * | 2/2014 | Yang et al. | 81/60 |
| 2009/0275685 | A1 * | 11/2009 | Hamel et al. | 524/404 |

* cited by examiner

*Primary Examiner* — David B Thomas

(57) ABSTRACT

A ratchet includes multiple ratchet teeth defined in the outer periphery thereof and a coated layer is coated along the outer periphery of the ratchet. A sand blasting device is used to blast sands to remove a part of the coated layer to define a circular endless opening on the coated layer, and the ratchet teeth protrude the coated layer from the openings.

13 Claims, 9 Drawing Sheets

RATCHET AND METHOD FOR MAKING THE SAME

RELATED APPLICATION

This application is a Continuation-in-Part of U.S. application Ser. No. 13/301,765, entitled "RATCHET WITH COATED LAYER AND THE METHOD FOR MAKING THE SAME", naming Cheng-Pu Yang and Sen-Yuan Hou as inventors, and filed on Nov. 21, 2011.

FIELD OF THE INVENTION

The present invention relates to a ratchet, and more particularly, to a ratchet with a coated layer to be more distinguishable and increase aesthetic features.

BACKGROUND OF THE INVENTION

Some of the conventional hand tools such as wrenches and sockets have a layer coated on the outer surface thereof for the aesthetic purposes and are disclosed in U.S. Pat. Nos. 6,082,227 and 7,028,588. The conventional ways to coat the layer include dying, Nickel electro-coating, Chromium electro-coating, Titanium electro-coating, Tin electro-coating, color electro-coating, painting, coloring and other known methods so as to improve the outer appearances of the tools and the size data can be seen from the coated layer.

The size of the tools is fixed so that the manufacturers often do not put the coated layer in consideration, especially that the coated layer does not affect the operation of the tools. However, the coated layer can be up to 0.5 mm which may affect the operation of ratchets. As shown in FIGS. 14 to 16, the ratchet 50 has a coated layer 60 coated thereon and the surfaces 51 of the ratchet teeth 500 are also coated with the coated layer 60 so that the height of the teeth 500 is increased and the gap 52 between the teeth 500 is reduced. The surface 61 of the coated layer 60 is not strong when the teeth 500 are operated so that the torque transmitted by the ratchet 50 is reduced. When the ratchet teeth 500 are engaged with a pawl, the depth that the teeth 500 are engaged with the pawl is reduced and the torque transmitted is reduced. If the ratchet is larger than 19 mm, the height from the bottom of the teeth to the tip of the teeth is 0.58 mm and the thickness of the coated layer 60 is 0.5 mm so that only a limited portion of the teeth is remained. The torque is reduced slightly. However, if the ratchet is a smaller one such as 8 mm ratchet, the height from the bottom of the teeth to the tip of the teeth is 0.28 mm and the thickness of the coated layer 60 is 0.5 mm so that there will be no teeth left and the engagement between teeth is failed, the lost of torque is significant. This is especially obvious for the ratchets of 8 mm to 15 mm.

The present invention intends to provide a ratchet with a coated layer which improves the outer appearance and provides more distinguishable feature, while the shape of the ratchet teeth is maintained.

SUMMARY OF THE INVENTION

The present invention relates to a ratchet and comprises multiple ratchet teeth defined in the outer periphery thereof and a coated layer is coated along the outer periphery of the ratchet. A sand blasting device is used to blast sands to remove a part of the coated layer to defined openings in the coated layer and the ratchet teeth protrude from the openings.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 2:
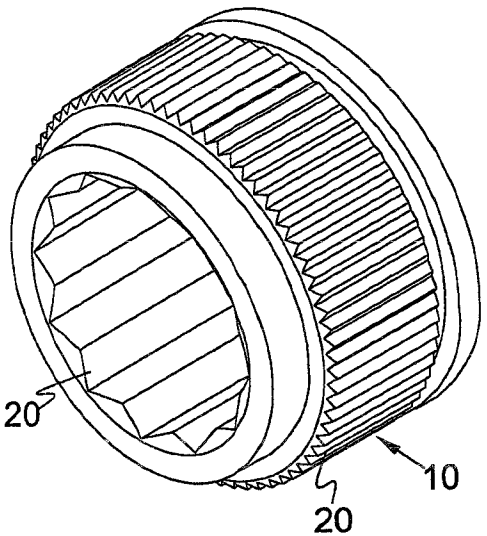
FIG. 2 is a perspective view to show the ratchet of the present invention, wherein the coated layer is coated to the ratchet.
Figure 9:
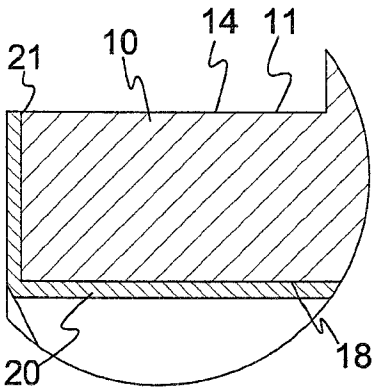
FIG. 9 is an enlarged view of the circled portion in FIG. 8.
Figure 8:
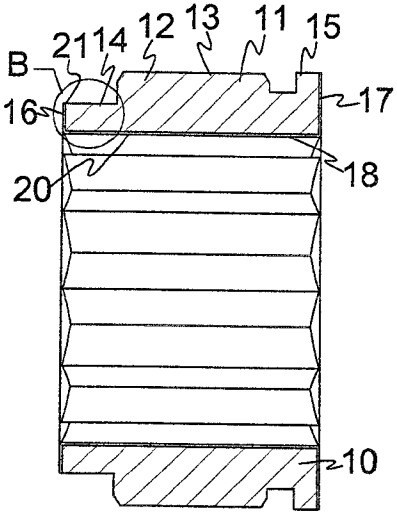
FIG. 8 shows that the coated layer on the ratchet is partly removed, the remained layer is existed on the inner periphery and the end faces.
Figure 10:
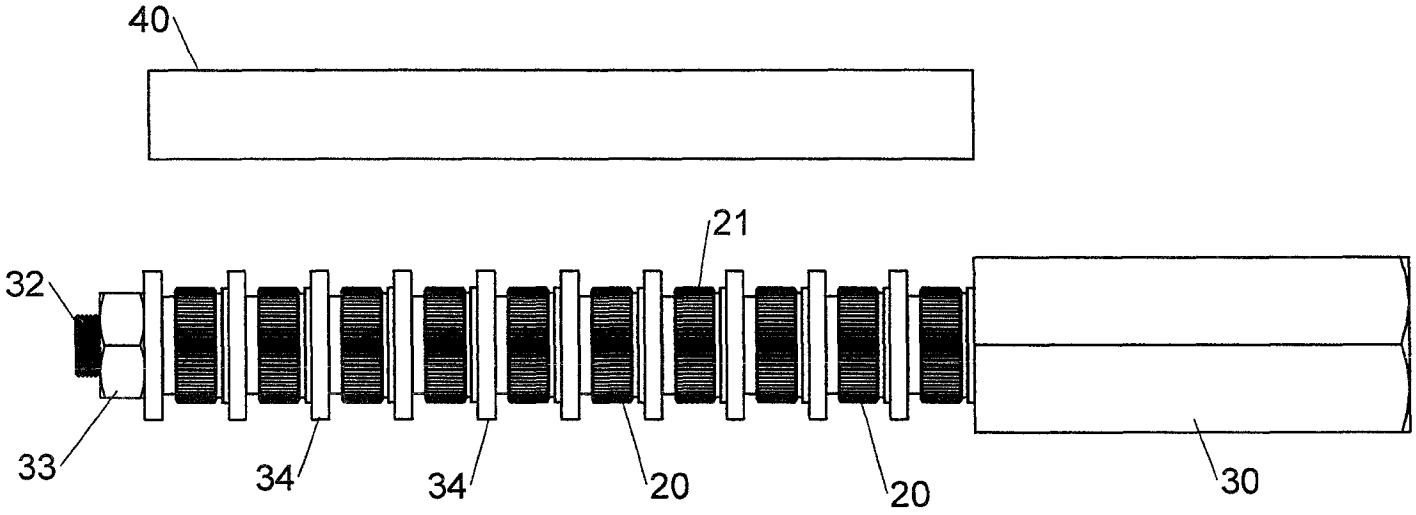
FIG. 10 shows that the ratchets and a plurality of spacers of the present invention are mounted to the rod.

Referring to FIGS. 8 and 9, the ratchet 10 of the present invention comprises multiple ratchet teeth 12 defined on the outer periphery 11 thereof so as to be located in the ratchet mechanism of a wrench to have one-way driving function. A coated layer 20 is coated to the surface of the ratchet 10 and has a circular endless opening 21 defined therethrough, the opening 21 is surrounding along the outer periphery 11 with respect to the central axis of the ratchet 10, and the ratchet teeth 12 protrude the coated layer 20 from the openings 21. In the drawings, the ratchet 10 is a ring-shaped member and has an outer periphery 11 and an inner periphery 18, the inner periphery 18 is coated with the coated layer 20. Multiple engaging ridges 19 extend from the inner periphery 18 of the ratchet 10 and are hold an object such as a nut or a bolt head. As shown in FIGS. 2 and 8, eighteen recesses 190 are defined between the engaging ridges 19. The recesses 190 are consecutive and each is a V-shaped recess. The inner periphery has at least 1 mm tolerance in the Deutsch Industrial Normen (DIN), so that when the coated layer 20 of 0.5 mm is coated, the object can be engaged with the inner periphery 18 so that the coated layer 20 at the inner periphery 18 does not need to be removed.

Figure 13:
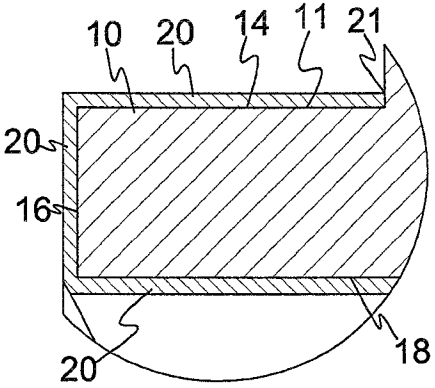
FIG. 13 is an enlarged view of the circled portion in FIG. 12.
Figure 12:
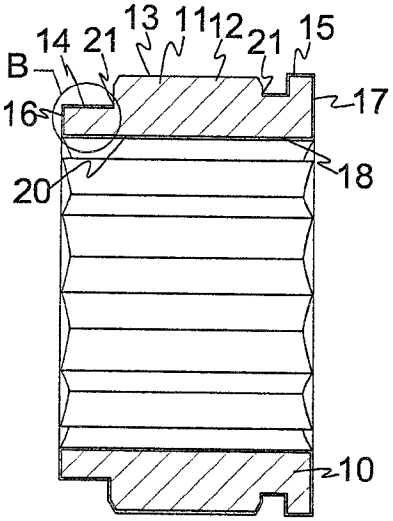
FIG. 12 shows that the coated layer on the middle section of the outer periphery of the ratchet is partly removed, the remained layer is existed on the end sections of the inner periphery and the end faces.
Figure 16:
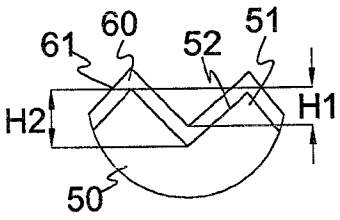
PRIOR ART FIG.16
FIG. 16 is an enlarged view of the circled portion F in FIG. 15.
Figure 15:
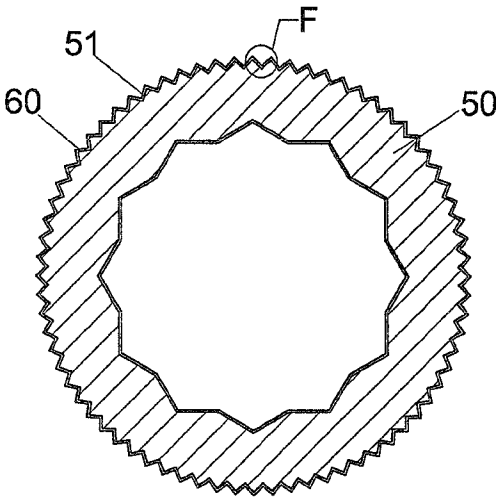
PRIOR ART FIG.15
FIG. 15 is a cross sectional view, taken along line E-E in FIG. 14.
Figure 14:
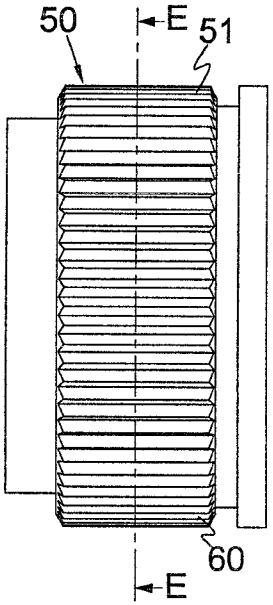
PRIOR ART FIG.14
FIG. 14 is a side view of the conventional ratchet.

As shown in FIGS. 12 and 13, the ratchet 10 has a middle section 13 and two end sections 14, 15 located on the outer periphery 11 along an axial direction of the ratchet 10, and the middle section 13 is located between the two end sections 14, 15. The ratchet teeth 12 are located at the middle section 13 and the two end sections 14, 15 are coated with the coated layer 20.

Figure 1:
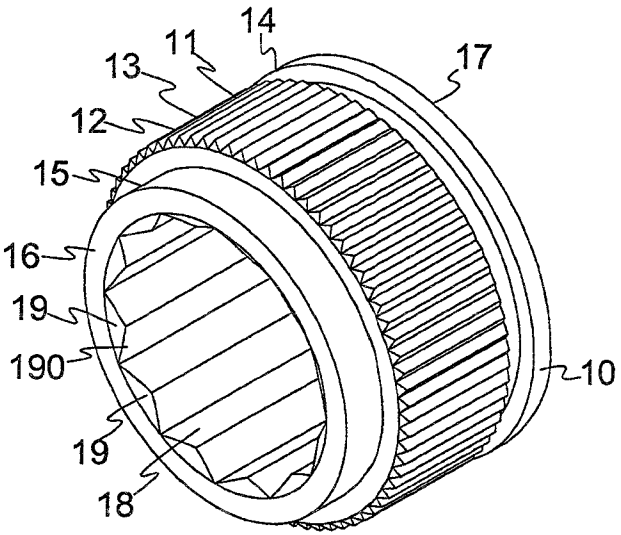
FIG. 1 is a perspective view to show the ratchet of the present invention.
Figure 5:
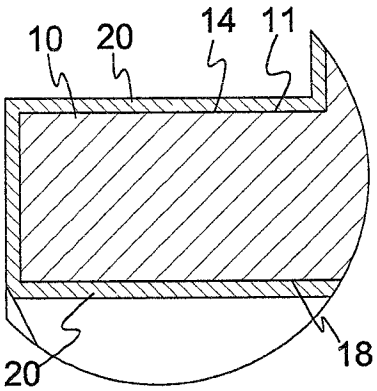
FIG. 5 is an enlarged view of the circled portion in FIG. 4.
Figure 4:
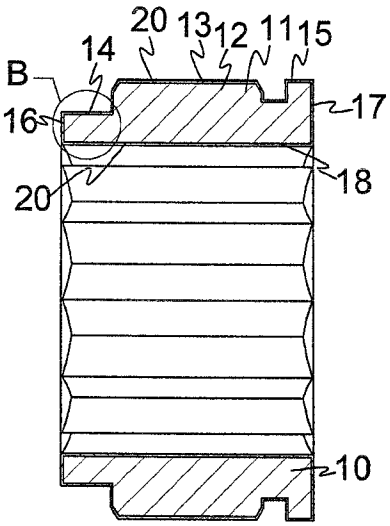
FIG. 4 is a cross sectional view, taken along line A-A in FIG. 3.
Figure 3:
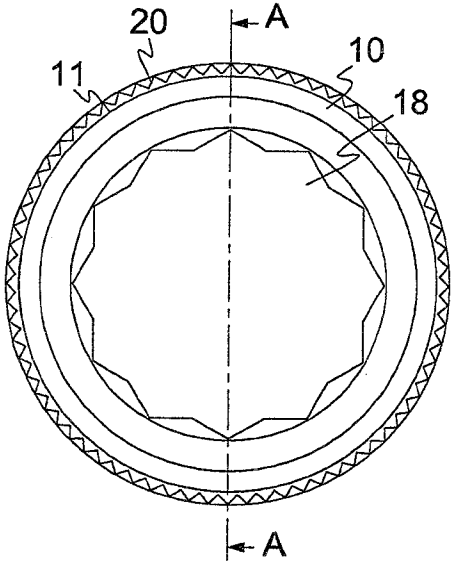
FIG. 3 is an end view to show the ratchet of the present invention, wherein the coated layer is coated to the ratchet.
Figure 11:
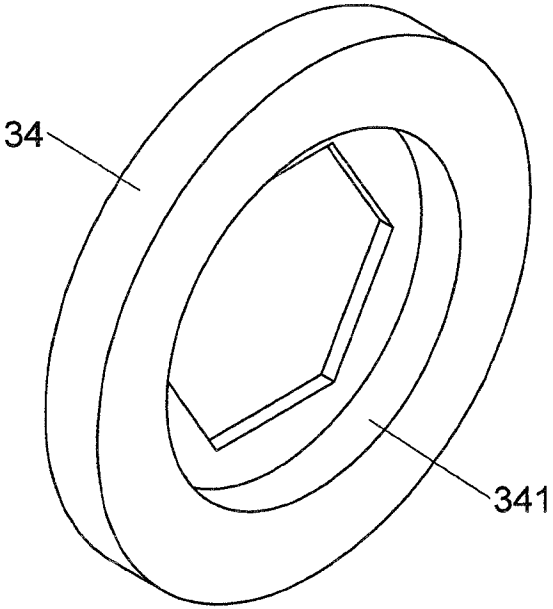
FIG. 11 a perspective view to show the spacer of the present invention.

As shown in FIG. 1, the ratchet 10 is made first. As shown in FIGS. 2 to 5, the ratchet 10 is processed by dying, Nickel electro-coating, Chromium electro-coating, Titanium electro-coating, Tin electro-coating, color electro-coating, painting, coloring and other known methods during the manufacturing of the ratchet 10 or after the ratchet 10 is made. The coated layer 20 is coated to all of the surfaces of the ratchet 10. As shown in FIGS. 2 to 5, the ratchet 10 is a ring-shaped member, and the coated layer 20 is coated to the outer periphery 11, the two ends faces 16, 17 and the inner periphery 12. As shown in FIGS. 2 to 7, the inner periphery 18 of the ratchet 10 is shaped to be matched with a rod 30. The rod 30 has one end connected with a nut 33 which restricts the ratchets 10 from dropping from the rod 30. Multiple ratchets 10 and a plurality of ring-shaped spacers 34 are sleeved on a rod 30 along a central axis of the rod 30 in an interlaced way, so that two opposite ends of two adjacent ratchets 10 contact and close by one spacer 34. The outer periphery 11 of the ratchet 10 has a middle section 13 and two end sections 14, 15 locating along an axial direction of the ratchet 10, the middle section 13 is located between the two end sections 14, 15, the ratchet teeth 12 are located at the middle section 13. As shown in FIGS. 11 to 13, two ends of the spacer 34 has a cavity 341 respectively, the end section 14, 15 inserts in the cavity 341, so that the end sections 14, 15 have the coated layer. As shown in FIGS. 7 to 9, a sand blasting device 40 is used to blast sands which moves along the rod 30 longitudinally back and forth, while the rod 30 and the ratchets 10 on the rod 30 are rotated at fixed speed, to remove the part of the coated layer 20 on the outer periphery 11 to define the opening 21.

Figure 6:
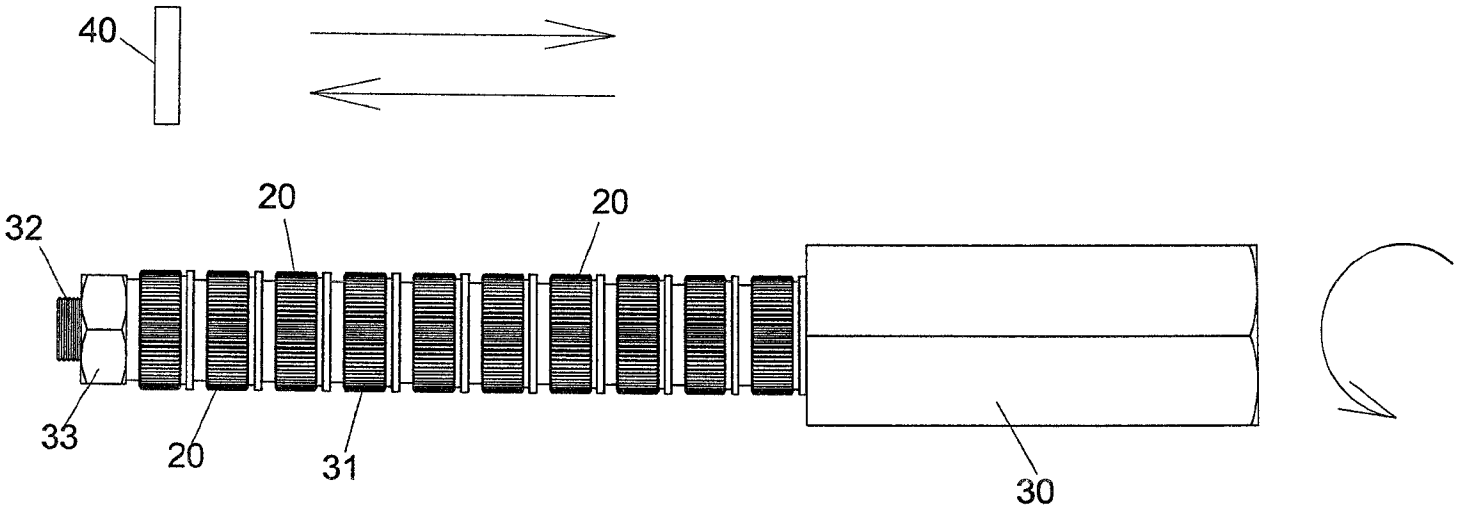
FIG. 6 shows that the ratchets of the present invention are mounted to the rod.
Figure 7:
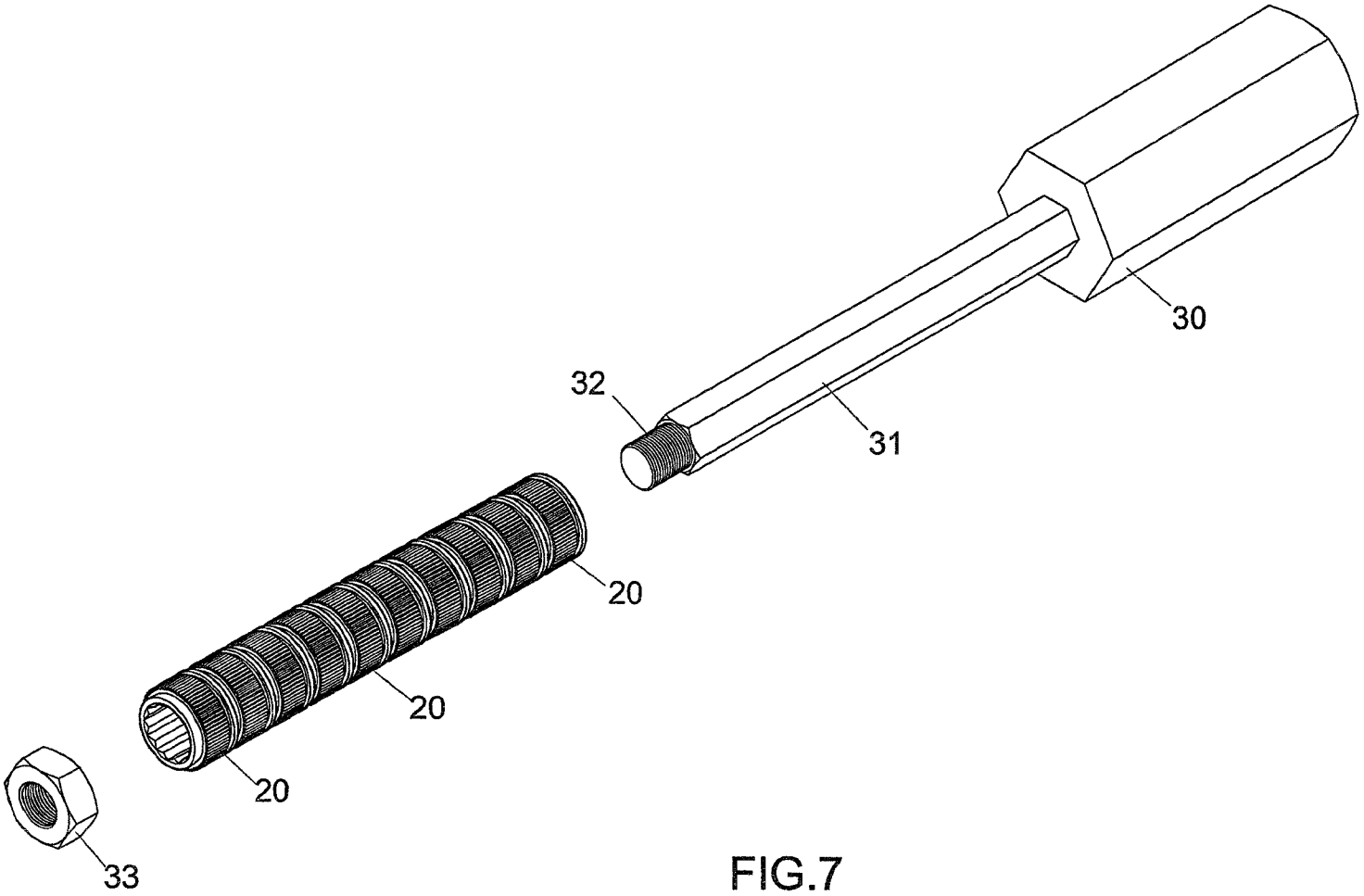
FIG. 7 shows that a part of the coated layer is removed by using a laser device.

As shown in FIG. 6, the ratchets 10 of the present invention may include different sizes (5 mm to 32 mm) and the rods 30 may have the middle section 31 of different sizes so that the ratchets 10 of different sizes can be mounted to the middle sections 31.

The coated layer 20 on the ratchets 10 improves the aesthetic appearance thereof and the ratchets 10 are more distinguishable. The coated layer 20 on the ratchets 10 have opening 21 for the ratchet teeth 12 to be exposed therefrom and this maintain the engagement ability and the torque transmitted is not affected. The ratchets 10 are ring-shaped members and the coated layer 20 on the inner periphery shows the characters that the coated layer 20 is supposed to be.

While we have shown and described the embodiment in accordance with the present invention, it should be clear to those skilled in the art that further embodiments may be made without departing from the scope of the present invention.

What is claimed is:

1. A method for making a ratchet with a coated layer, comprising:

step a: providing at least one ratchet and multiple ratchet teeth defined on an outer periphery of the at least one ratchet;

step b: coating a coated layer along the whole surface of the at least one ratchet, and step c: using a sand blasting device to blast sands to remove a part of the coated layer to defined a circular endless opening surrounding along the outer periphery with respect to a central axis of the at least one ratchet, and the ratchet teeth protruding the coated layer from the opening.

2. The method as claimed in claim 1, wherein there are multiple ratchets and each ratchet is a ring-shaped member, the multiple ratchets and a plurality of ring-shaped spacers are sleeved on a rod along a central axis of the rod in an interlaced way, so that two opposite ends of two adjacent ratchet contact and close by one spacer, in the step c, the multiple ratchets are mounted to the rod which rotates at a fixed speed, the sand blasting device moves along the rod longitudinally back and forth to remove the part of the coated layer on the outer periphery to define the opening.

3. The method as claimed in claim 2, wherein the outer periphery of the ratchet has a middle section and two end sections locating along an axial direction of the ratchet, the middle section is located between the two end sections, the ratchet teeth are located at the middle section; two ends of the spacer has a cavity respectively, the end section inserts in the cavity, so that the end sections have the coated layer.

4. The method as claimed in claim 1, wherein the coated layer in the step b is a metal layer which is electro-coated to the at least one ratchet.

5. The method as claimed in claim 4, wherein the metal layer comprises at least one of Nickel, Chromium, Titanium and Tin.

6. The method as claimed in claim 1, wherein the coated layer in the step b is a metal layer which is color electro-coated to the at least one ratchet.

7. A ratchet comprising:

multiple ratchet teeth being defined on an outer periphery of the ratchet and a coated layer being coated to a surface of the ratchet, the coated layer having an circular endless opening surrounding along the outer periphery with respect to a central axis of the ratchet and the ratchet teeth protruding the coated layer from the openings.

8. The ratchet as claimed in claim 7, wherein the ratchet has a middle section and two end sections on the outer periphery and the middle section and the two end sections are located along an axial direction of the ratchet, the middle section is located between the two end sections, the ratchet teeth are located at the middle section and the two end sections are coated with the coated layer.

9. The ratchet as claimed in claim 7, wherein two end faces of the ratchet are coated with the coated layer.

10. The ratchet as claimed in claim 7, wherein the ratchet is a ring-shaped member and has an inner periphery, the inner periphery is coated with the coated layer.

11. The ratchet as claimed in claim 10, wherein multiple engaging ridges extend from the inner periphery of the ratchet and are adapted to hold an object.

12. The ratchet as claimed in claim 11, wherein multiple recesses are defined between the engaging ridges.

13. The ratchet as claimed in claim 12, wherein the multiple recesses are consecutive and each is a V-shaped recess.

* * * * *